US009310168B2

(12) United States Patent
Hoenes et al.

(10) Patent No.: US 9,310,168 B2
(45) **Date of Patent: *Apr. 12, 2016**

(54) STRUCTURE FOR INTEGRATING SOLDIER SYSTEM ELECTRONICS WITH BODY ARMOR

(75) Inventors: Eric C. Hoenes, Austin, TX (US); Michael McElroy, Gilbert, AZ (US); Allister McNeish, Austin, TX (US); Alvaro D. Lewin, Austin, TX (US); Kenneth G. Grove, Austin, TX (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 53 days.

This patent is subject to a terminal disclaimer.

(21) Appl. No.: 13/056,477

(22) PCT Filed: May 27, 2010

(86) PCT No.: PCT/US2010/036383

§ 371 (c)(1),
(2), (4) Date: Jan. 28, 2011

(87) PCT Pub. No.: WO2010/138704

PCT Pub. Date: Dec. 2, 2010

(65) Prior Publication Data

US 2011/0126696 A1 Jun. 2, 2011

Related U.S. Application Data

(60) Provisional application No. 61/181,777, filed on May 28, 2009.

(51) Int. Cl.
*F41H 1/02* (2006.01)

(52) U.S. Cl.
CPC ..... *F41H 1/02* (2013.01)

(58) Field of Classification Search
CPC ..... F41H 1/00; F41H 1/02; F41H 5/04; F41H 5/0414
USPC ..... 89/36.05; 2/2.5
See application file for complete search history.

(56) References Cited

U.S. PATENT DOCUMENTS

| | | | | |
|---|---|---|---|---|
| 6,507,486 | B2 * | 1/2003 | Peterson, III | 361/679.03 |
| 7,805,767 | B2 | 10/2010 | McElroy et al. | |
| 7,921,757 | B1 * | 4/2011 | Vavrick et al. | 89/36.05 |
| 8,001,623 | B2 * | 8/2011 | Gertsch et al. | 2/422 |
| 2007/0245441 | A1 * | 10/2007 | Hunter | 2/2.5 |
| 2009/0027229 | A1 * | 1/2009 | Fortson et al. | 340/870.07 |
| 2009/0282595 | A1 * | 11/2009 | Branson et al. | 2/2.5 |
| 2012/0182834 | A1 * | 7/2012 | Mullen et al. | 367/118 |

* cited by examiner

*Primary Examiner* — Bret Hayes
(74) *Attorney, Agent, or Firm* — Daniel J. Long; Kimberly A. Peaslee

(57) ABSTRACT

In the structure for providing protection for the human body from ballistic projectiles which includes one or more ballistic resistant panels overlying at least a portion of the body, wherein the improvement comprising one or more electronic devices integrated into at least one of the ballistic resistant panels.

6 Claims, 5 Drawing Sheets

STRUCTURE FOR INTEGRATING SOLDIER SYSTEM ELECTRONICS WITH BODY ARMOR

CROSS REFERENCE TO RELATED APPLICATIONS

This application claims priority from U.S. Application Ser. No. 61/181,777 filed May 28, 2009, the contents of which are incorporated herein by reference.

BACKGROUND OF THE INVENTION

1. Field of the Invention

The present invention relates to body armor and more particularly to structures for integrating electronic systems with body armor.

2. Brief Description of Prior Developments

Warfighters are currently encumbered by numerous individual electronic devices, including radios, GPS systems and mobile computers. These devices duplicate displays, input/output devices and power supplies, environmental enclosures and each has its own set of batteries, adding to the weight to be carried by the soldier. Conventionally components are placed in outer pockets, or attached to the load bearing equipment.

Disadvantages of the prior art may include the fact that the outer pockets become cluttered, that movements may be inhibited or restricted by dangling or otherwise exposed parts, and that those parts may be more likely to be damaged in combat and by harsh environments.

Efforts have been made to provide increased sensing, signal processing and other capability to aid warfighters while minimizing the duplications of capabilities and batteries to reduce the soldier's burden.

A need still exists, however, to provide soldier system data processing, communications, navigation, situational awareness, command and control, and other capabilities at reduced weight and with minimum encumberance and without constraining the wearer's movements.

SUMMARY OF INVENTION

According to the present invention components are integrated into soldier body armor protecting them against damage, minimizing package weight and protecting them from the environment. More particularly, in this way the electronics do not add to the existing encumberance of the armor and save weight by dispensing with individual enclosures.

BRIEF DESCRIPTION OF THE DRAWINGS

The present invention is further described with reference to the accompanying drawings wherein.

DETAILED DESCRIPTION OF THE PREFERRED EMBODIMENT

Figure 1:
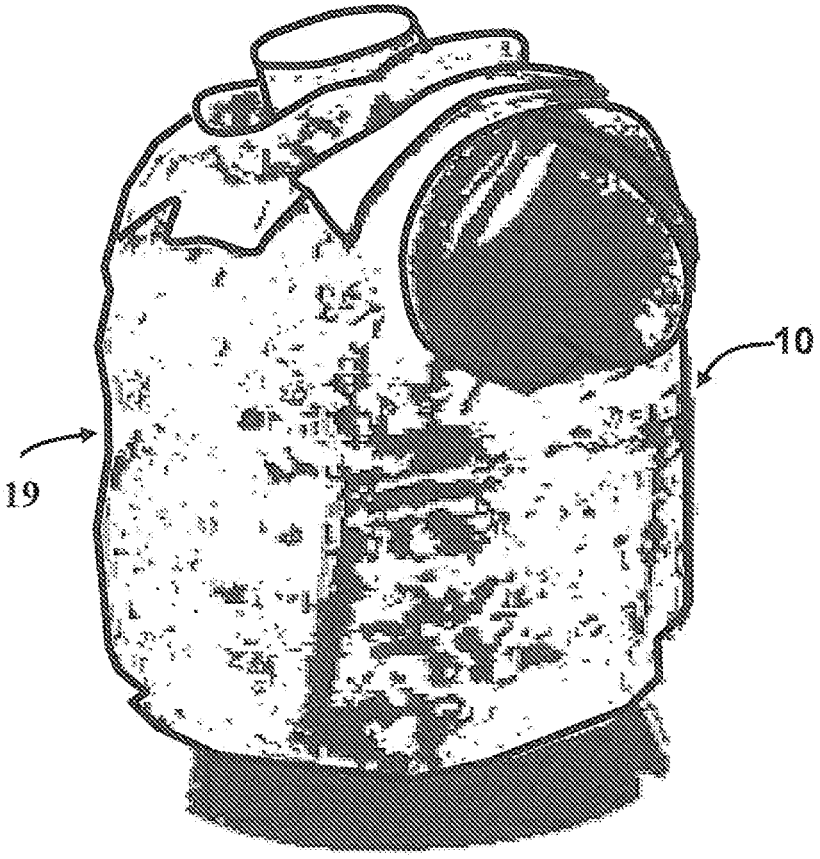
FIG. 1 is a perspective view of a preferred embodiment of the integrated operational tactical vest (IOTV) of the present invention.
Figure 2:
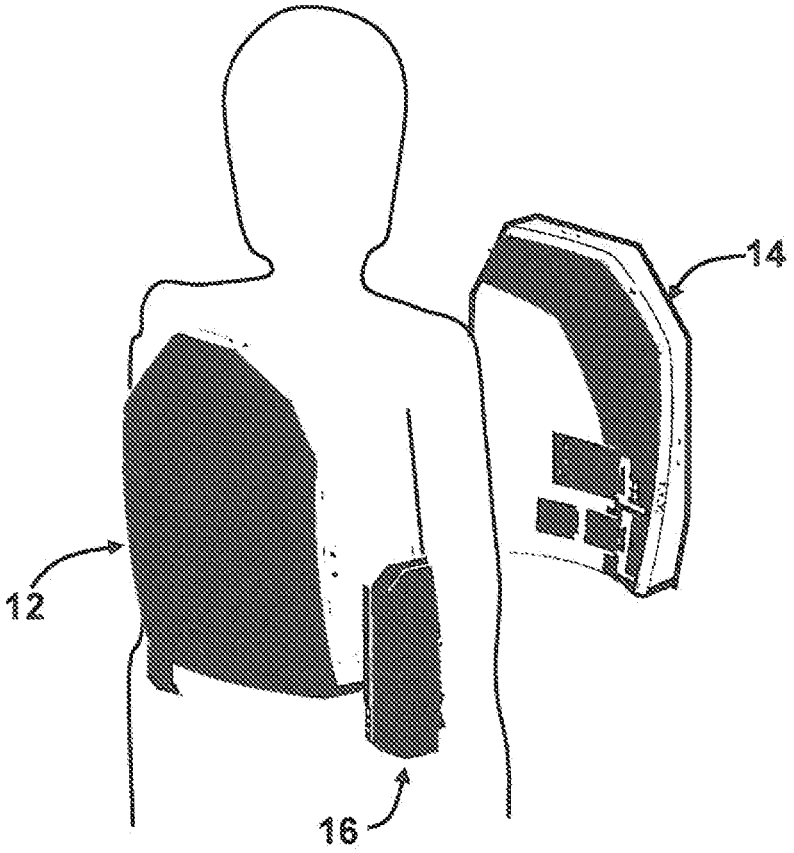
FIG. 2 is an encoded perspective view of the IOTV shown in FIG. 1.
Figure 3:
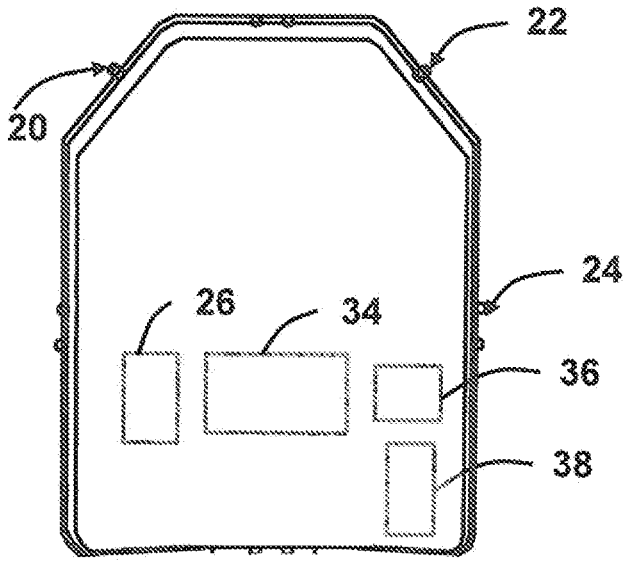
FIG. 3 is a front elevational view of the rear panel of the IOTV shown in FIG. 1.

Referring to FIGS. 1-3, the IOTV 10 includes a ballistic resistant front panel 12 and rear panel 14 and a side panel 16 and an opposite side panel (not shown). The preferred material from which the ballistic resistant panel is made is a silicon carbon ceramic composite armor which is available from BAE Systems, Security and Survivability group located in Phoenix Ariz. In addition other materials suitable potential materials would include a soft, flexible aramid (available as Goldflex Honeywell, GA 2010 Honeywell, GN 2115 KM2, 600-dn plain weave KM2, 850-dn, style 705); a soft, flexible polyethylene (available as DSM SB21 DSM SB31 DSM SB61 Honeywell, SA 1211 Honeywell, SA 3113 Honeywell, SA 3118 Spectra 1000, 215-dn, style 945 Spectra 1000, 215-dn, style 955 Spectra 1000, 375-dn, style 960 Spectra 2000, 180-dn, style 1711); a rigid aramid (available as GV 2016 Honeywell, GV-2112 1000-dn T-Flex(PP) KM2, 850-dn, neoprene coated Barrday, style 1013 Kevlar w/ARG film); rigid polyethylene (available as Dyneema, HB2 Dyneema, HB25 Dyneema, HB26 Dyneema, HB50/51 Dyneema, X32 Honeywell, SR-1214 Honeywell, SR-3124 Honeywell, SR-3130 BAE Systems, Tensylon Gen II BAE Systems, Tensylon Gen IV); and a rigid glass fiber (available as Unidirectional E-glass, Polystrand Hyper Tex 3Tex). The IOTV also includes an exterior camouflaged fabric cover 19. The rear panel includes connectors 20 and 22, power plugs as at 24, a multi-function RF system (MF/RF) 26 including a radio transmitter and receiver for ground and satellite communications which also include a jammer, a single board computer (SBC) 28, a multi-function input/output board (MF I/O board) 34, a power management unit 36, and a navigation system 38 with Global Positioning System (GPS) 38 capability and an Inertial Measurement Unit (IMU), for GPS disciplined navigation.

Figure 4:
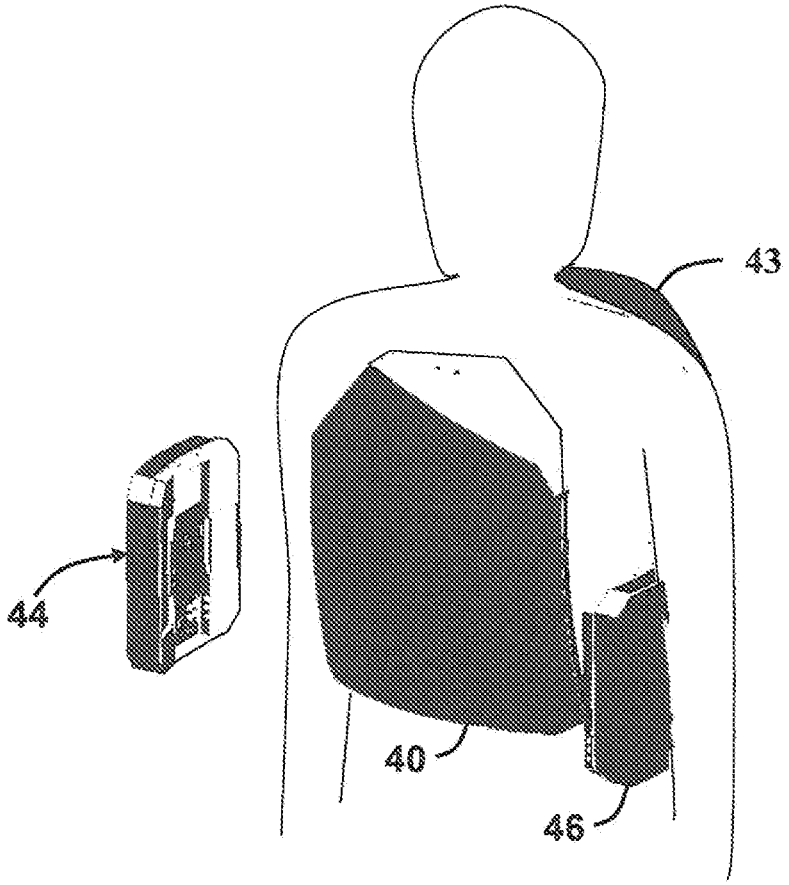
FIG. 4 is an exploded perspective view of an alternate preferred embodiment of the vest of the present invention.

Referring to FIG. 4, the alternative preferred embodiment of the vest of this invention includes a ballistic resistant front panel 40, rear panel 43 and opposed side panels 44 and 45.

Figure 5:
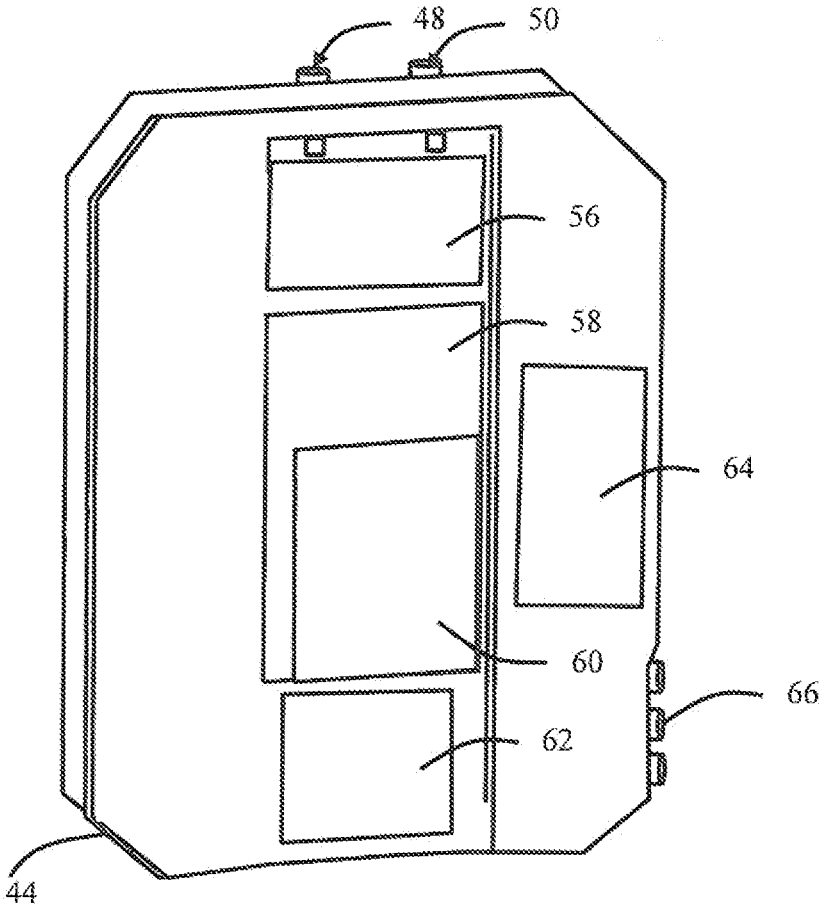
FIG. 5 is a front elevational view of a side panel of the vest shown in FIG. 4.

Referring to FIG. 5, the side panel 44 includes connectors 48 and 50. The connectors are preferably Souriau 85TA Series connectors. The side panel 44 also includes multi-function radio frequency (RF) System (MF/RF) 56 including a radio transmitter and receiver for ground and satellite communications which also include a jammer, single board computer (SBC) 58, multi-function input/output board (MF I/O board) board 60, integrated power system 64, power management unit 62, navigation system 38 with Global Positioning System (GPS) capability and an Inertial Measurement Unit (IMU) for GPS disciplined navigation, and power plugs as at plug 66.

Those skilled in the art will appreciate that the vest of the present invention the components are secured and protected and do not inhibit or restrict movement. Since the inertial measurement unit is better coupled to the wearer, it is subject to less noise and more directly reflects the wearer's movements. Battery duplication is limited and multiple environmental enclosures eliminated, saving weight and power.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An integrated operational tactical vest for providing protection for a human body from ballistic projectiles comprising:

a rigid ballistic resistant front panel wherein the front panel protects the chest and stomach of a human body;

a rigid ballistic resistant rear panel wherein the rear panel protects the back of a human body; and wherein the rear panel includes a plurality of electronic devices including at least, a power management unit, a single board computer (SBC), a multi-function input/output board (MF I/O board), connectors, power plugs, and a navigation system with a global positioning system and an inertial measurement unit, integrated inside said ballistic resistant rear panel.

2. The integrated operational tactical vest of claim 1 wherein a pair of rigid opposed ballistic resistant side panels are interposed for connecting the ballistic resistant front panel and the ballistic resistant rear panel and protecting the sides of a human body excluding shoulders.

3. The integrated operational tactical vest of claim 1 which includes a multi-function radio frequency (RF) system.

4. The integrated operational tactical vest of claim 1 which has a camouflaged cover.

5. The integrated operational tactical vest of claim 1 wherein said plurality of electronic devices provides capabilities to aid war fighters.

6. An integrated operational tactical vest for providing protection for a human body from ballistic projectiles comprising:

a rigid ballistic resistant front panel wherein the front panel protects the chest and stomach of a human body;

a rigid ballistic resistant rear panel wherein the rear panel protects the back of a human body; and a pair of rigid opposed ballistic resistant side panels are interposed for connecting the ballistic resistant front panel and the ballistic resistant rear panel and protecting the sides of a human body excluding shoulders; wherein the pair of rigid opposed ballistic resistant side panels include a plurality of electronic devices including at least, a power management unit, a single board computer (SBC), a multi-function input/output board (MFI I/O board), connectors, power plugs, and a navigation system with a global positioning system and an inertial measurement unit, integrated inside at least one of the rigid opposed ballistic resistant side panel amongst the pair of rigid opposed ballistic resistant side panels.

* * * * *